US009045271B2

(12) United States Patent
Matheison et al.

(10) Patent No.: US 9,045,271 B2
(45) Date of Patent: Jun. 2, 2015

(54) PACKAGING DEVICES, SYSTEMS AND METHODS

(75) Inventors: Ron Matheison, Golden, CA (US); Troy Merrell, Corona Del Mar, CA (US)

(73) Assignee: EPE Industries USA Inc, Fountain Valley, CA (US)

( * ) Notice: Subject to any disclaimer, the term of this patent is extended or adjusted under 35 U.S.C. 154(b) by 0 days.

(21) Appl. No.: 13/281,200

(22) Filed: Oct. 25, 2011

(65) Prior Publication Data

US 2013/0048534 A1 Feb. 28, 2013

Related U.S. Application Data

(60) Provisional application No. 61/527,867, filed on Aug. 26, 2011.

(51) Int. Cl.
*B65D 81/00* (2006.01)
*B65D 81/03* (2006.01)
*B65D 81/05* (2006.01)

(52) U.S. Cl.
CPC ..... *B65D 81/03* (2013.01); *B65D 81/051* (2013.01)

(58) Field of Classification Search
CPC ..... B65D 81/05; B65D 81/07; B65D 81/107; B65D 81/1075; B65D 81/113
USPC ..... 206/591, 523, 585
See application file for complete search history.

(56) References Cited

U.S. PATENT DOCUMENTS

| | | | | | |
|---|---|---|---|---|---|
| 3,339,722 | A * | 9/1967 | Antwerpen | 206/453 |
| 3,575,781 | A | 4/1971 | Pezely | |
| 3,606,886 | A * | 9/1971 | Bittner | 128/894 |
| 4,241,832 | A * | 12/1980 | Bliss | 206/523 |
| 5,547,238 | A * | 8/1996 | Payette | 292/343 |
| D382,353 | S * | 8/1997 | Berger | D25/157 |
| 5,882,776 | A * | 3/1999 | Bambara et al. | 428/215 |
| D419,862 | S * | 2/2000 | Berger | D8/402 |
| 6,073,770 | A | 6/2000 | Park | |
| D433,320 | S * | 11/2000 | Ware et al. | D8/402 |
| D438,095 | S * | 2/2001 | Berger | D8/402 |
| D438,784 | S * | 3/2001 | Berger | D8/402 |
| 7,861,865 | B2 * | 1/2011 | Green | 206/600 |
| 2008/0043409 | A1 * | 2/2008 | Kallabis | 361/679 |

FOREIGN PATENT DOCUMENTS

| | | |
|---|---|---|
| WO | 2009-054723 A1 | 4/2009 |
| WO | 2010-148490 A1 | 12/2010 |

OTHER PUBLICATIONS

International Search Report and Written Opinion from related PCT application No. PCT/US2012/052353.

* cited by examiner

*Primary Examiner* — Anthony Stashick
*Assistant Examiner* — Ernesto Grano
(74) *Attorney, Agent, or Firm* — Eric L. Lane; Green Patent Law

(57) ABSTRACT

A cushioning device comprises a compressible dot having a top cushioning surface and a substantially flat attachment surface. The compressible dot is adapted to increase in density in correlation with increasing compression force exerted on the compressible dot. The top cushioning surface is adapted to increase in contact surface area in correlation with increasing compression force exerted on the compressible dot. A packaging system comprises a packaging container having an inner surface and a compressible dot having a top cushioning surface and a substantially flat attachment surface, the compressible dot being attached to the inner surface of the packaging container.

16 Claims, 10 Drawing Sheets

PACKAGING DEVICES, SYSTEMS AND METHODS

CROSS-REFERENCE TO RELATED APPLICATION

This application is a non-provisional of and claims priority to U.S. Patent Application Ser. No. 61/527,867, filed Aug. 26, 2011, which is hereby incorporated by reference in its entirety.

FIELD

The present disclosure relates to devices, systems and methods for packaging and shipping.

BACKGROUND

Cushioning devices for product packaging and shipping are increasingly needed as global trade continues to expand. As more complicated and expensive electronics devices and industrial products are shipped around the world, there is a need for more sophisticated and more effective shock absorbing cushioning devices to protect these products during shipping.

Some known packaging materials and devices include bubble wrap, air bags, honeycomb cardboard, and polystyrene (styrofoam peanuts). Some of these materials are heavy and therefore increase shipping and fuel costs. Other known packaging materials, such as polystyrene blocks or molded plastics, are designed and manufactured specifically for particular products. However, this can be wasteful and unduly expensive as different specialty materials need to be made for a large variety of different products and cannot typically be re-used. Other materials such as air bags and bubble wrap often get destroyed in shipping and cannot be re-used. Furthermore, many of the plastics and polystyrene materials are not recyclable or biodegradable.

Accordingly, there is a need for a cushioning device and packaging system that can be universally used to ship a large variety of different products. There also is a need for a cushioning device and packaging system that is relatively cheap, easily manufactured and scalable.

SUMMARY

The embodiments of the present disclosure alleviate to a great extent the disadvantages of known packaging materials and methods by providing a cushioning device and packaging system including compressible dots that vary in density and contact surface area in correlation with different weights and compression forces of the items to be packaged. A plurality of compressible dots can be attached to the inner surface of a packaging container and placed at various strategically designated locations to best protect the items to be packaged and shipped.

Disclosed embodiments of cushioning devices and packaging systems provide for effective replacement for all current shipping containers utilizing interior cushioning, dunnage, or block and brace designs. More particularly, disclosed embodiments provide ease of packaging use for multiple shape and weighted products within the same container and direct specific directional cushioning protection to the products only where it is needed, thereby reducing costs over traditional cushioning solutions. Disclosed embodiments reduce material waste over traditional packaging designs, reduce packaging weight, and reduce the need to stock multiple size packages for random products. Disclosed embodiments of cushioning devices and packaging systems provide for a clean, environmentally sound and reusable packaging solution as an effective replacement option for expanded polystyrene/peanuts, bubble, interlocking chipboard, air bags, or any standard filler material. Disclosed embodiments are easily manufactured to meet any packaging application and engineered to meet ISTA transit requirements.

Exemplary embodiments of a cushioning device comprise a compressible dot having a top cushioning surface and a substantially flat attachment surface. The compressible dot is adapted to increase in density in correlation with increasing compression force exerted on the compressible dot. The top cushioning surface of the compressible dot is adapted to increase in contact surface area in correlation with increasing compression force exerted on the compressible dot.

The compressible dot may be any number of shapes. Exemplary embodiments of a compressible dot may have a half-spheroid shape, a pyramid shape, a half-cylinder shape, a cone shape, or any number of three dimensional geometries. Compressible dots of different shapes could be used together in the same package to provide increased protection for the item to be packaged and shipped. In exemplary embodiments, a skin is formed on the top cushioning surface, and the top cushioning surface may define a skin texture pattern indented into the top cushioning surface.

Exemplary embodiments include a packaging system comprising a packaging container having an inner surface and a compressible dot attached to the inner surface of the packaging container. The compressible dot has a top cushioning surface and a substantially flat attachment surface. A skin may be formed on the top cushioning surface, and the top cushioning surface may define a skin texture pattern indented into the top cushioning surface. In exemplary embodiments, the compressible dot is adapted to increase in density in correlation with increasing compression force exerted on the compressible dot. The top cushioning surface may also be adapted to increase in contact surface area in correlation with increasing compression force exerted on the compressible dot. In exemplary embodiments, a plurality of compressible dots are attached to the inner surface of the packaging container. The compressible dot may have one or more of: a half-spheroid shape, a pyramid shape, a half-cylinder shape, a cone shape, or any number of three dimensional geometries.

In exemplary embodiments, a method of packaging products is provided comprising providing a compressible dot having a top cushioning surface and a substantially flat attachment surface. The compressible dot provided may be adapted to increase in density in correlation with increasing compression force exerted on the compressible dot. The top cushioning surface may be adapted to increase in contact surface area in correlation with increasing compression force exerted on the compressible dot. Exemplary methods may further comprise forming a skin on the top cushioning surface and indenting a skin texture pattern into the top cushioning surface of the compressible dot. Exemplary methods may further comprise providing a packaging container having an inner surface and attaching one or more compressible dots to the inner surface of the packaging container. Exemplary methods may further comprise placing an item to be shipped in the packaging container.

Accordingly, it is seen that cushioning devices, packaging systems, and packaging methods are provided which can be universally used to ship a large variety of different products having different shapes and weights. The disclosed cushioning devices and packaging systems are relatively cheap, easily manufacturable and scalable and direct specific directional cushioning protection to the products where is it needed. These and other features and advantages will be appreciated from review of the following detailed description, along with the accompanying figures in which like reference numbers refer to like parts throughout.

BRIEF DESCRIPTION OF THE DRAWINGS

The foregoing and other objects of the disclosure will be apparent upon consideration of the following detailed description, taken in conjunction with the accompanying drawings, in which.

DETAILED DESCRIPTION

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations of the present disclosure. As used herein, the "present disclosure" refers to any one of the embodiments described herein, and any equivalents. Furthermore, reference to various aspects of the disclosure throughout this document does not mean that all claimed embodiments or methods must include the referenced aspects.

Figure 1:
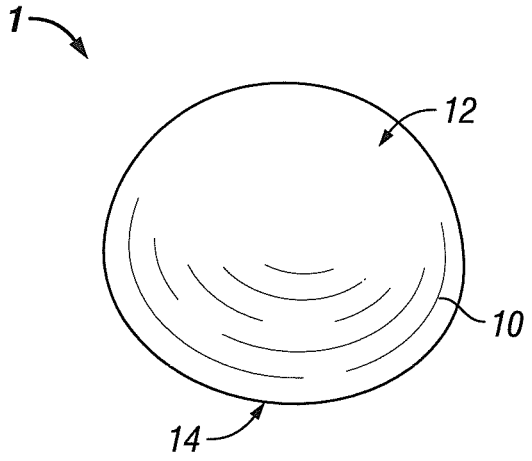
FIG. 1 is a perspective view of an embodiment of a cushioning device in accordance with the present disclosure.
Figure 2A:
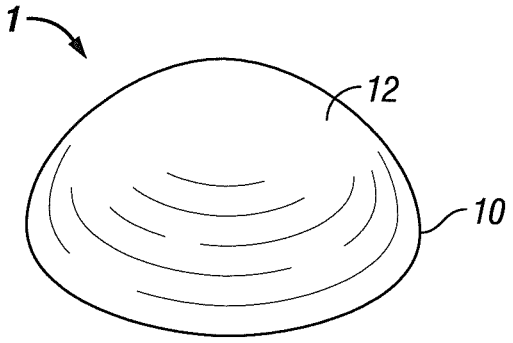
FIG. 2A is a perspective view of an embodiment of a cushioning device in accordance with the present disclosure.
Figure 2B:
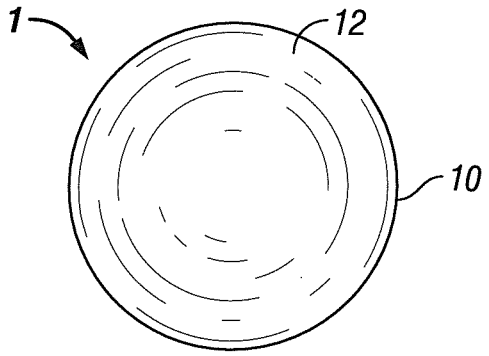
FIG. 2B is a top view of the cushioning device of FIG. 2A.
Figure 2C:
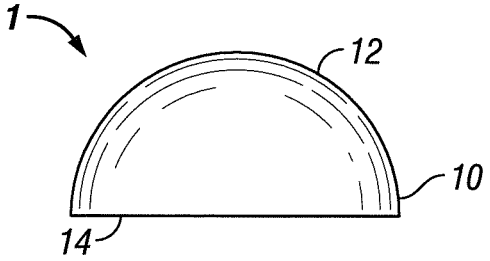
FIG. 2C is a side view of the cushioning device of FIG. 2A.
Figure 7:
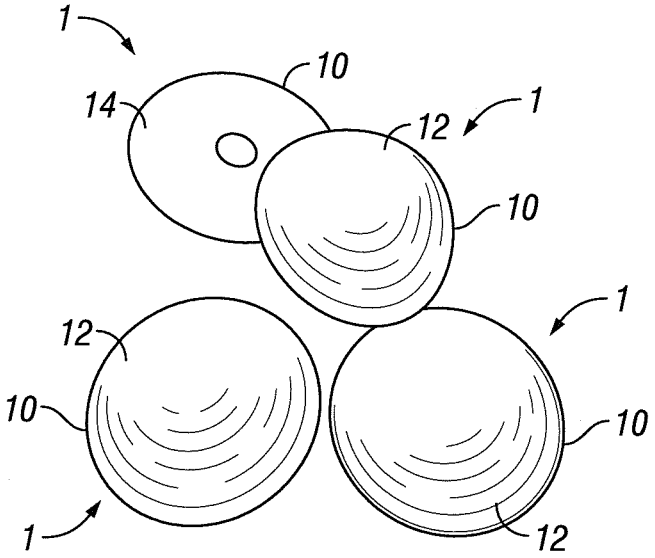
FIG. 7 is a perspective view of embodiments of cushioning devices in accordance with the present disclosure.
Figure 8:
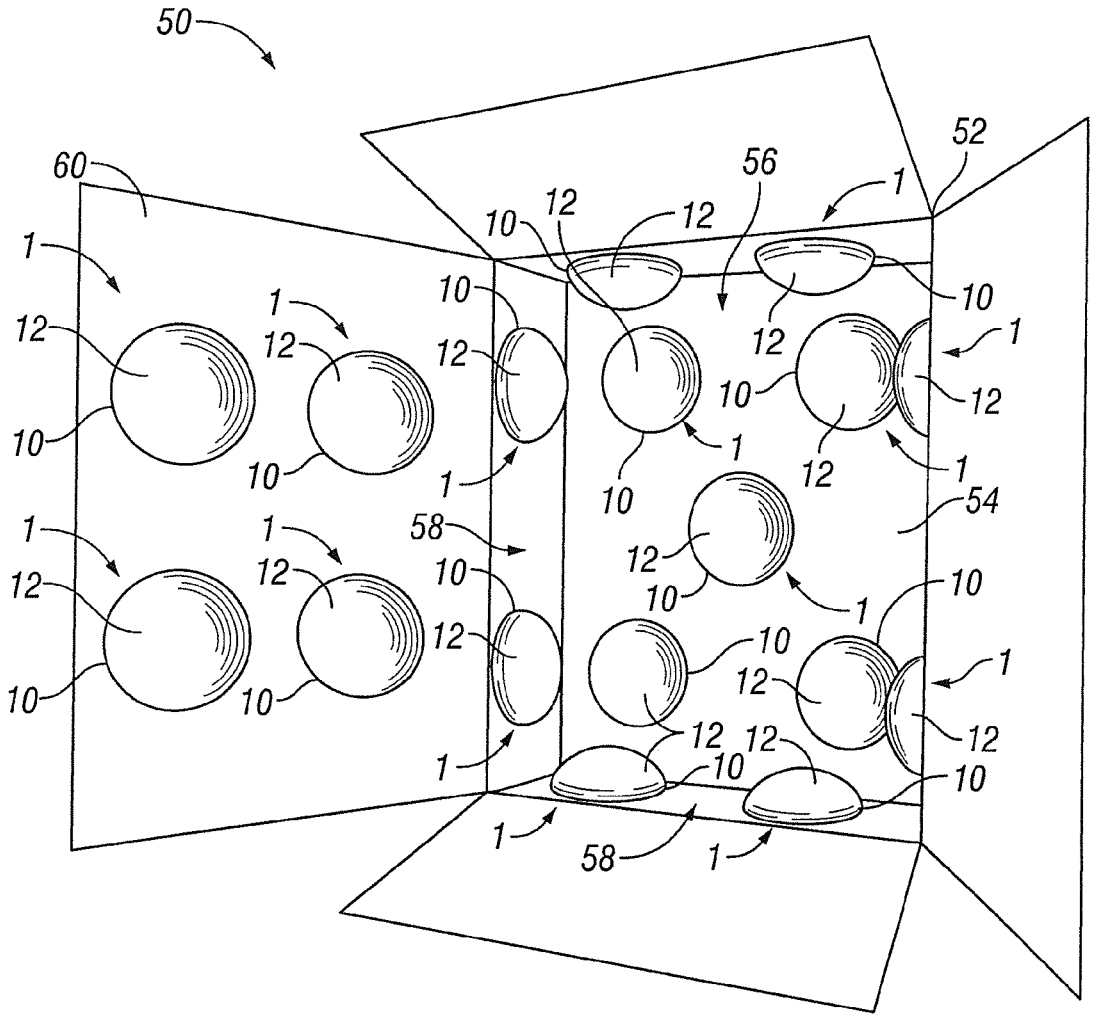
FIG. 8 is a perspective view of an embodiment of a packaging system in accordance with the present disclosure.
Figure 9:
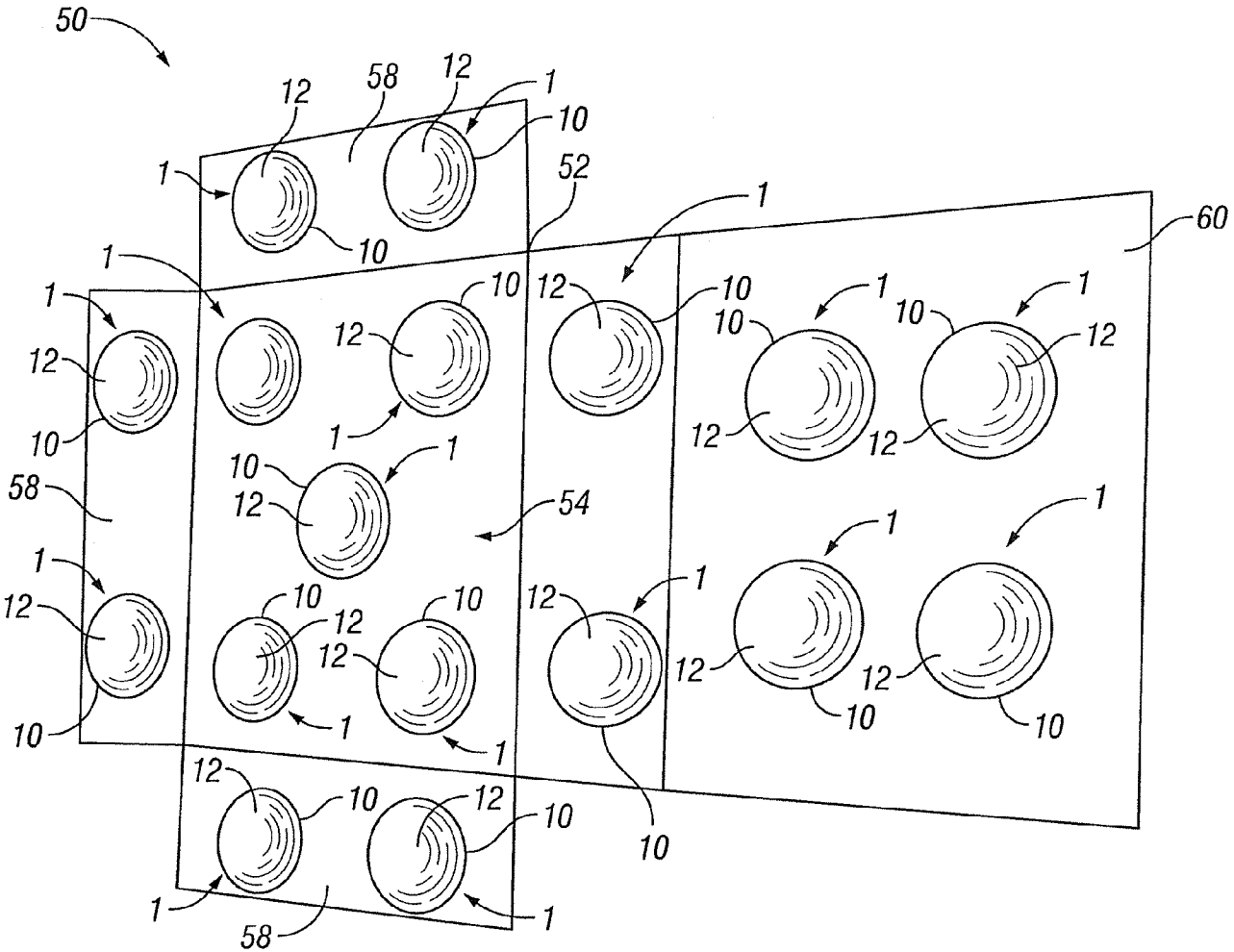
FIG. 9 is a perspective view of an embodiment of a packaging system in accordance with the present disclosure.
Figure 10:
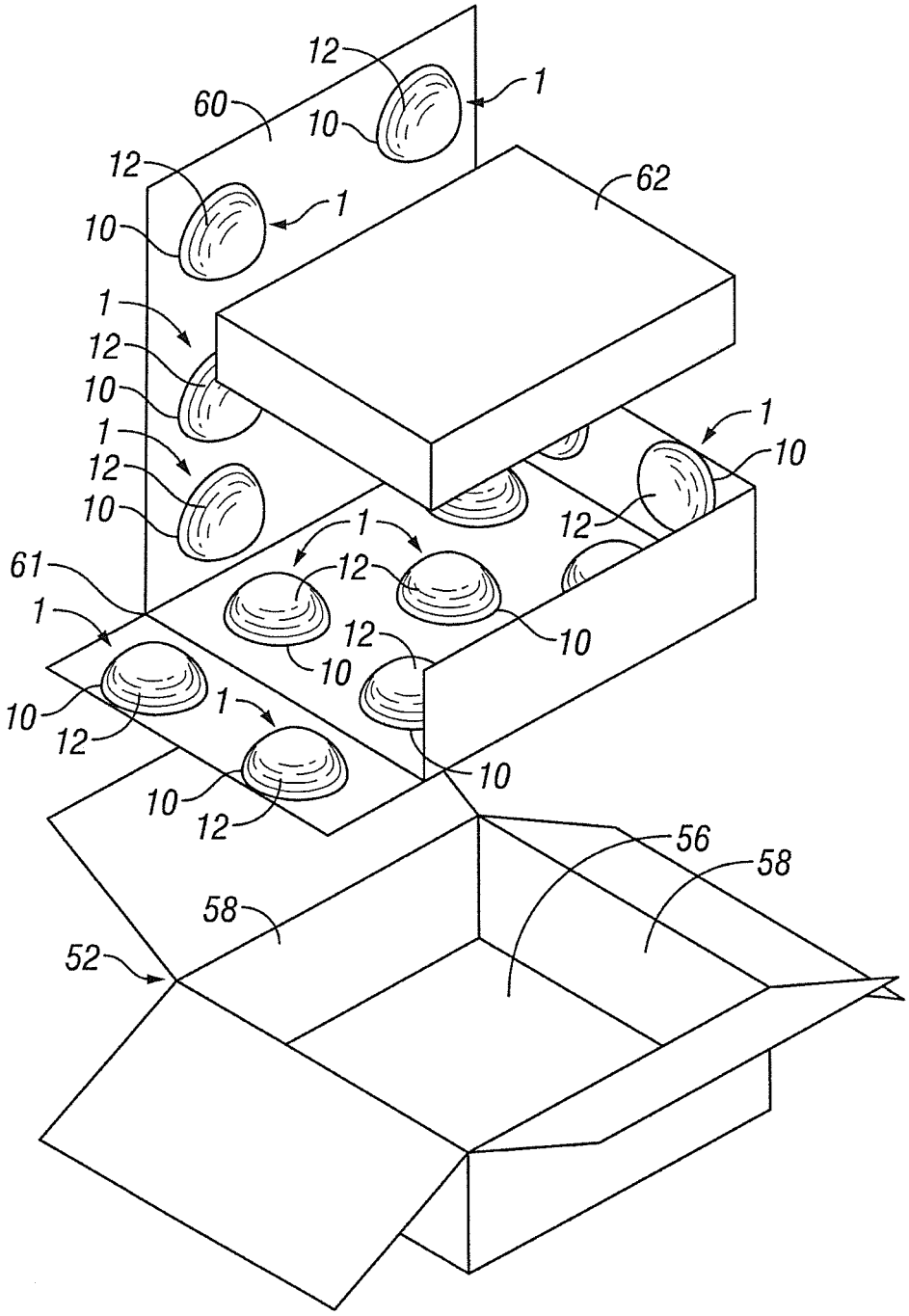
FIG. 10 is an exploded view of an embodiment of a packaging system in accordance with the present disclosure.
Figure 11:
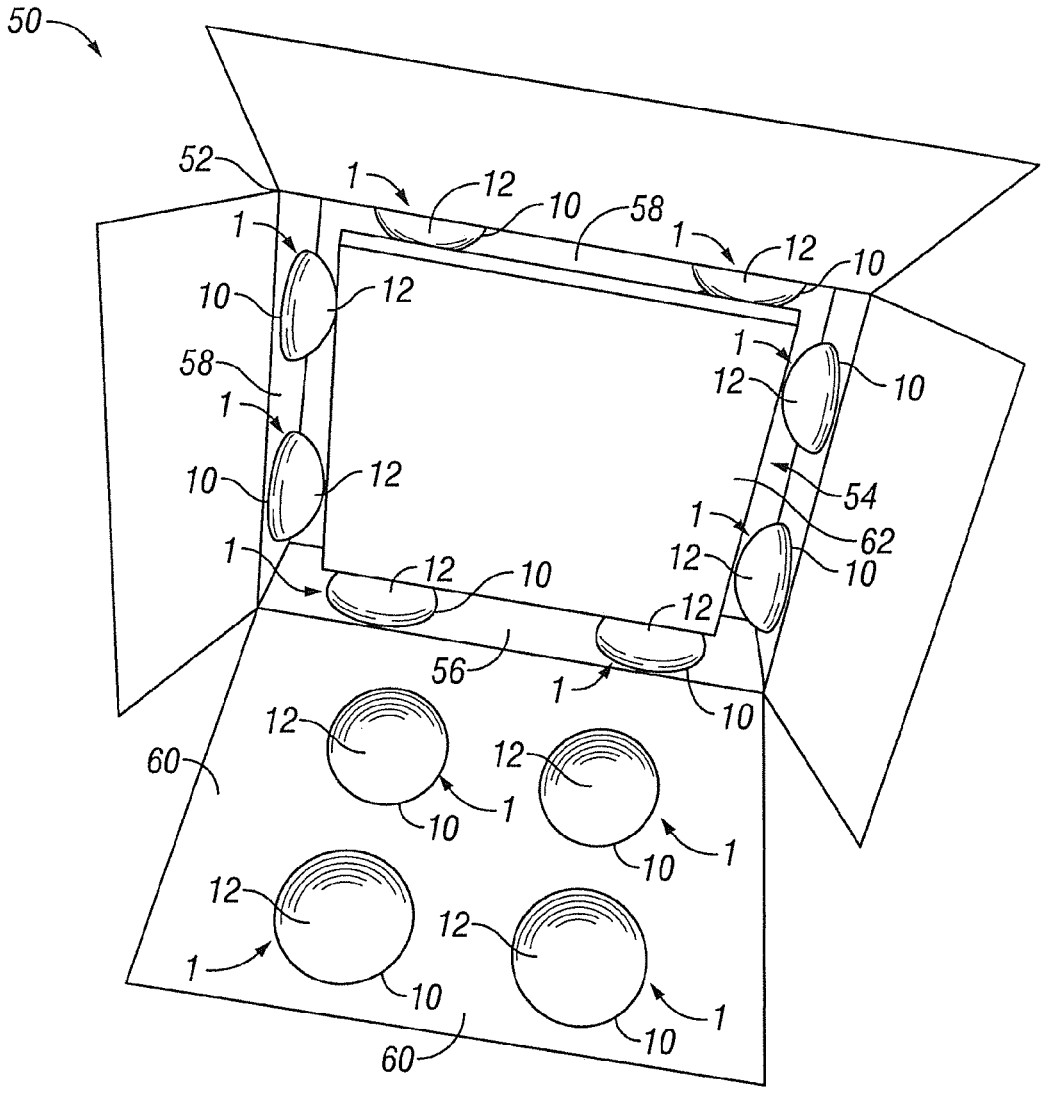
FIG. 11 is a perspective view of an embodiment of a packaging system in accordance with the present disclosure.

FIGS. 1 and 2A-C show an exemplary embodiment of a cushioning device used for cushioning and shock absorption during the handling, packing, shipping, unpacking and return shipments of solid products or objects. Cushioning device 1 comprises a compressible dot 10, which has a top cushioning surface 12 to cushion the products being packaged and shipped, and an attachment surface 14. The attachment surface 14 is designed for engagement and attachment to inner surfaces of packaging containers and will typically be substantially flat for this purpose, as shown in FIGS. 2C and 7. However, the attachment surface 14 may vary and could be any shape or configuration depending on the type of packaging container being used.

Similarly, the compressible dot 10 could have a variety of shapes and configurations as its top cushioning surface 12. As best seen in FIGS. 2A-2C, an exemplary shape is a half-spheroid. The size of the compressible dot 10 may vary dramatically depending on the size and weight of the product being shipped. In general, exemplary embodiments may have a product height of about 1.5 inches with a diameter of about 4.0 inches. A variety of sizes of half-spheroid dots could be used, and exemplary half-spheroid embodiments include, but are not limited to, a dot having a radius of 1.0 inch and a height of 0.75 inches, a dot having a radius of 2.0 inches and a height of 1.5 inches, and a dot having a radius of 3.0 inches and a height of 2.25 inches.

Figure 3A:
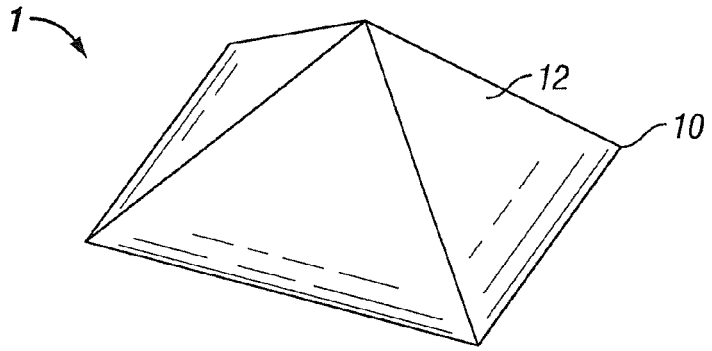
FIG. 3A is a perspective view of an embodiment of a cushioning device in accordance with the present disclosure.
Figure 3B:
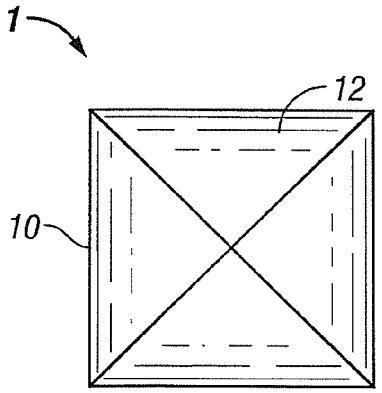
FIG. 3B is a top view of the cushioning device of FIG. 3A.
Figure 3C:
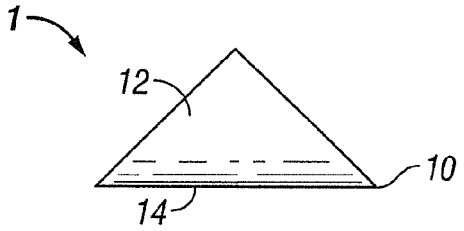
FIG. 3C is a side view of the cushioning device of FIG. 3A.
Figure 4A:
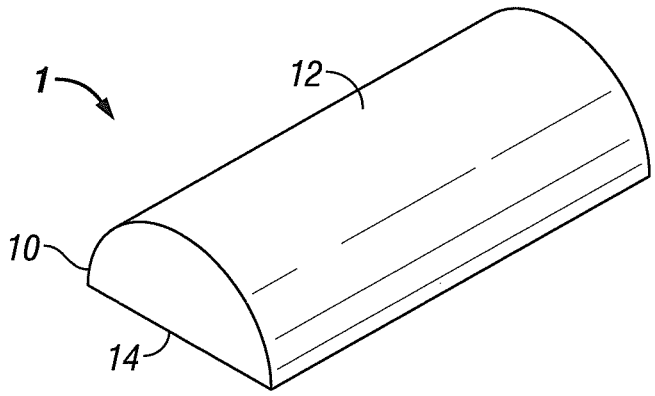
FIG. 4A is a perspective view of an embodiment of a cushioning device in accordance with the present disclosure.
Figure 4B:
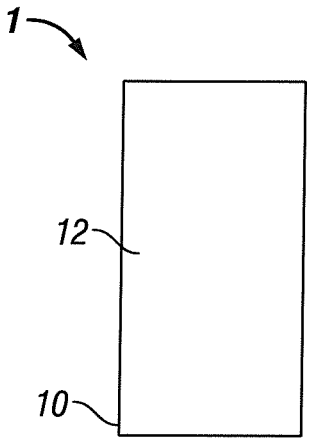
FIG. 4B is a top view of the cushioning device of FIG. 4A.
Figure 4D:
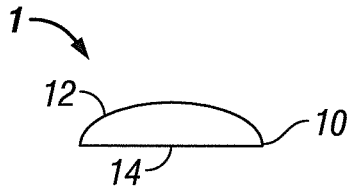
FIG. 4D is a side view of the cushioning device of FIG. 4A.
Figure 4C:
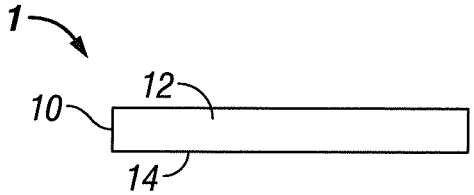
FIG. 4C is a cross-sectional view of the cushioning device of FIG. 4A.

Depending on the type of product to be packaged and shipped, other dot shapes could be employed. As shown in FIGS. 3A-3C, a pyramidal shape could be used. A variety of sizes of pyramidal dots could be used, and exemplary pyramidal embodiments include, but are not limited to, a dot having a width of 2.0 inches, a length of 2.0 inches and a height of 0.75 inches, a dot having a width of 4.0 inches, a length of 4.0 inches and a height of 1.5 inches, and a dot having a width of 6.0 inches, a length of 6.0 inches, and a height of 2.25 inches. FIGS. 4A-4D illustrate a half cylinder shape. A variety of sizes of half-cylinder dots could be used, and exemplary half-cylinder embodiments include, but are not limited to, a dot having a radius of 1.0 inch, a height of 0.75 inches and a length of 4.0 inches, a dot having a radius of 2.0 inches, a height of 1.5 inches and a length of 6.0 inches, and a dot having a radius of 3.0 inches, a height of 2.25 inches and a length of 8.0 inches. Other possible shapes include, but are not limited to, cone shape, triangle or half triangle, oval or half oval, square, rectangle, and U-shaped. The compressible dots also could be manufactured in any number of colors to be color-coded for specific applications and customers. The full color spectrum is available with the addition of coloring agents into the raw material prior to dispersion.

Figure 13:
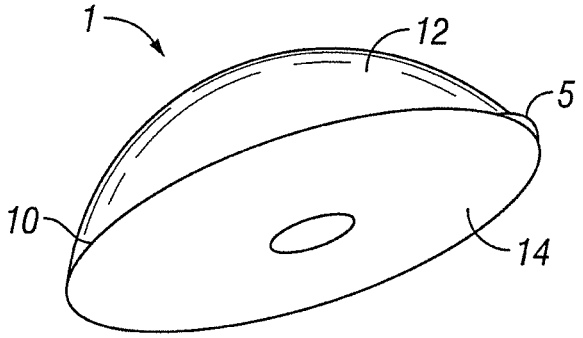
FIG. 13 is a perspective view of an embodiment of a cushioning device in accordance with the present disclosure.

In exemplary embodiments, a skin 5 may form on the top cushioning surface 12 of the compressible dot 10, as best seen in FIG. 13. With reference to FIGS. 5A-5E, it can be seen that exemplary embodiments of cushioning devices may have textured surfaces in the skin to better hold products during shipping and handling. More particularly, the top cushioning surface 12 of the compressible dot 10 could be manufactured to define a skin texture pattern 16 in its surface. The skin 5 and texture patterns 16 provide tackiness or "non-slip" characteristics and maximize the coefficient of friction of the top cushioning surface 12 of the compressible dot 10. This increased friction and "grip" is such that products in contact with the top cushioning surface 12 of the compressible dot 10 stay in place when packaged. Thus, the skin 5 and skin texture pattern 16 are advantageous in that they allow the top cushioning surface 12 of the compressible dot 10 to "grab" onto the product to mitigate movement and prevent shifting of the product inside the packaging container during shipping.

Figure 5A:
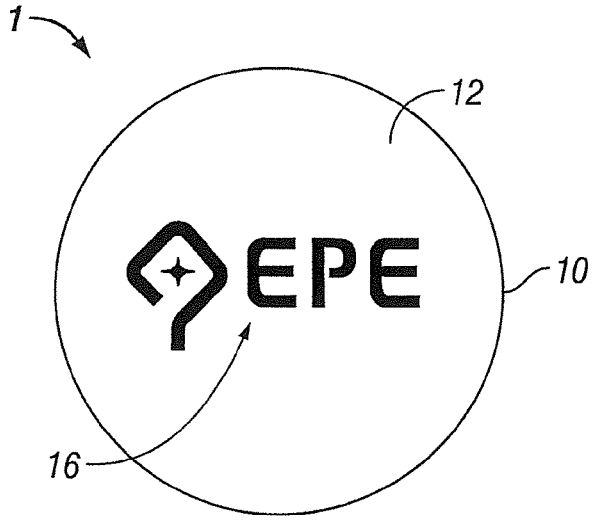
FIG. 5A is a top view of an embodiment of a cushioning device in accordance with the present disclosure showing an exemplary skin texture pattern.
Figure 5B:
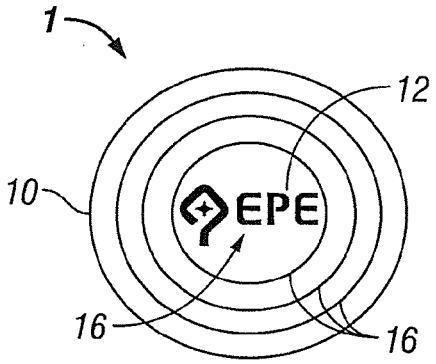
FIG. 5B is a top view of an embodiment of a cushioning device in accordance with the present disclosure showing an exemplary skin texture pattern.
Figure 5C:
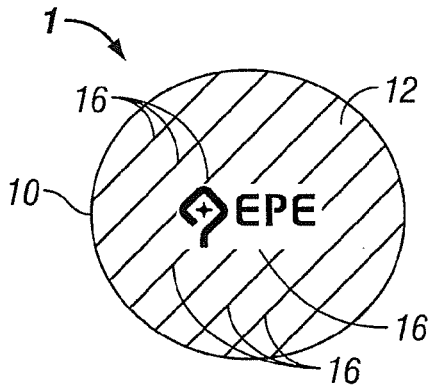
FIG. 5C is a top view of an embodiment of a cushioning device in accordance with the present disclosure showing an exemplary skin texture pattern.
Figure 5D:
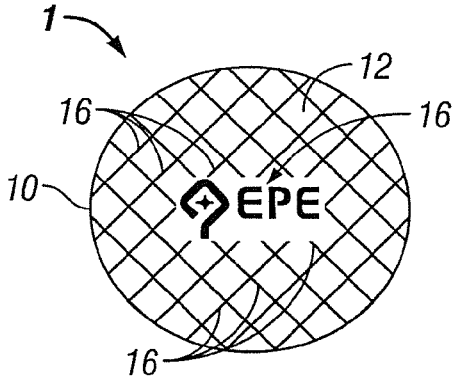
FIG. 5D is a top view of an embodiment of a cushioning device in accordance with the present disclosure showing an exemplary skin texture pattern.
Figure 5E:
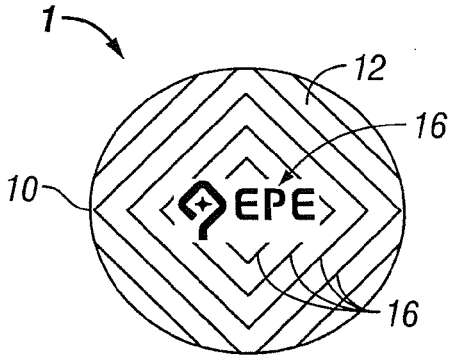
FIG. 5E is a top view of an embodiment of a cushioning device in accordance with the present disclosure showing an exemplary skin texture pattern.

In exemplary embodiments, these textures 16 are indented into the top cushioning surface 12 of the compressible dot 10 through raised designs engraved on the mold during manufacture. Although raised lines and logos are possible, they are more prone to tears, rips and shearing, so creating texture by indentation is better for durability reasons. Additionally, the indented texture (versus raised texture) is more easily manufactured. Additional texturing may be added to the product depending on customer requests. Exemplary texture patterns are shown in FIGS. 5A-5E. FIG. 5A illustrates a company logo texture pattern. FIG. 5B illustrates a concentric circle texture pattern. FIG. 5C illustrates a diagonal line texture pattern. FIG. 5D illustrates a cross-hatched texture pattern, and FIG. 5E illustrates a concentric diamond texture pattern.

Figure 6A:
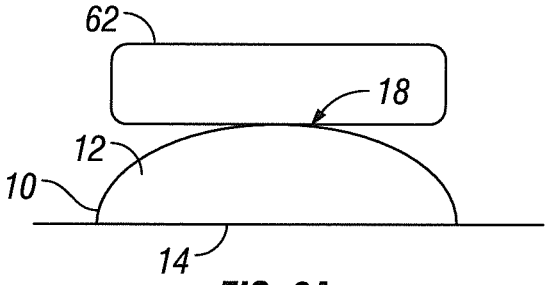
FIG. 6A is a diagram of an embodiment of a cushioning device in accordance with the present disclosure illustrating compression and surface area qualities of the device.
Figure 6B:
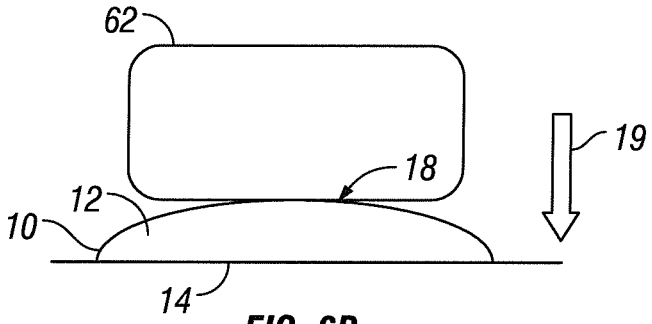
FIG. 6B is a diagram of an embodiment of a cushioning device in accordance with the present disclosure illustrating compression and surface area qualities of the device.

Referring to FIGS. 6A and 6B, one of the significant advantages of disclosed cushioning devices is their ability to adjust to the mechanical load of various product weights and compression forces. This ability flows from the shape and materials of the cushioning devices, which could be made of polyurethane, polystyrene, polypropylene, polyethylene, and foam-type material of any of these, and/or any other material resilient enough to be compressed and then return to its original shape, including, but not limited to plastic, rubber, etc., as well as biodegradable and/or compostable materials such as bio-based resins and polymers and other organic or inorganic materials, including, but not limited to, natural materials like starch, corn, wood pulp and cotton, potato, sugar-beet, soy, tobacco, sugar cane, cellulose and lignite.

Due to the property characteristics, the compressible dots are able to conform and cushion a multitude of product shapes, sizes and weights, either within the same container or in different containers. More particularly, the geometry and materials of exemplary compressible dots 10 are designed to adjust inversely proportional to the mechanical load of varying product weights by increasing their density and contact surface area 18 (the surface area in contact with the product to be shipped) of the top cushioning surface 12 as the weight of the product 62 increases and the increased compression force 19 of the product is exerted on the dot 10.

This effect is shown in FIG. 6B. With a relatively heavy product, the compressible dot increases in both contact surface area 18 and density. Heavy products have higher compression and a larger bearing area; therefore the dot density is higher. More particularly, heavier products that require larger bearing areas and increased spring constants will compress the dot material to the necessary deflection to achieve the required cushioning, thereby extending the duration of impact to allow the energy of potential shocks to be dissipated over a longer period of time. As shown in FIG. 6A, light products have little compression and small bearing area; therefore the dot is at its lightest density. More particularly, a lighter product 62 (requiring smaller bearing area) will compress the dot 10 minimally, allowing an almost free floating containment cage. The dot 10 is at a very light density and has a smaller contact surface area 18 in these instances.

The densities of the compressible dots may vary considerably depending on the desired spring constant associated with product weights. In exemplary embodiments, the density range of disclosed compressible dots is about 4 pounds per cubic foot to about 14 pounds per cubic foot in their unloaded states. It should be noted that, due to these characteristics, the disclosed cushioning devices 1 are reusable as they are resilient and return to their original molded shape after use, allowing for multiple uses.

Turning to FIGS. 8-11, packaging systems employing disclosed cushioning devices will now be described. An exemplary embodiment of a packaging system 50 comprises a packaging container 52 having an inner surface 54 and one or more cushioning devices 1 attached to the inner surface 54 of the container 52. The cushioning device 1 is a compressible dot 10 substantially as described above. An exemplary compressible dot 10 has a top cushioning surface 12 and an attachment surface 14. The attachment surface 14 may be substantially flat to facilitate smooth attachment to and engagement with inner surfaces 54 of the packaging container 52. As discussed in detail above, the compressible dot 10 will vary in density and its top cushioning surface will vary in contact surface area depending on the weight and compression force exerted on it by the item to be packaged and shipped.

Figure 12:
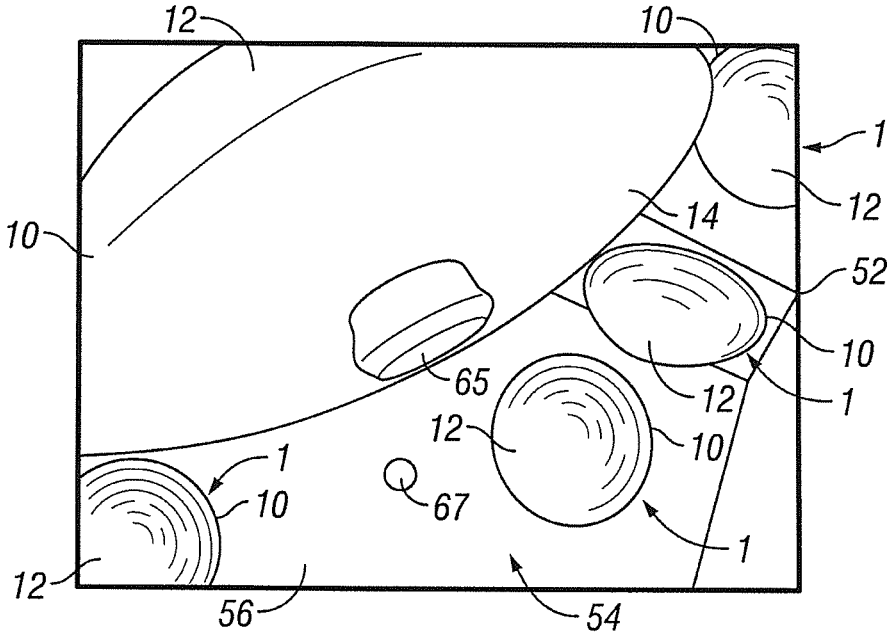
FIG. 12 is a perspective view of an embodiment of a cushioning device in accordance with the present disclosure.

The compressible dots 10 may be arranged on the inner surfaces 54 of the packaging container 52 in strategically designated locations and quantities to achieve the desired dampening effect. Thus, compressible dots 10 could be located on any interior surface, including the interior bottom surface 56, one or more interior side surfaces 58, the interior top surface 60, and any additional packaging inserts 61. The dots 10 may be affixed using glue, hot melt adhesives, or other types of adhesive. Also, the dot could have a "foot" or protrusion 65 on its attachment surface 14 to be inserted into appropriately sized apertures 67 in a packaging container, as shown in FIG. 12, enabling the dots to be affixed to the container without an adhesive product.

In operation, cushioning devices 1 such as compressible dots 10 are made, for example, of polyurethane by an injection molding process using a mold. As discussed above, the dots would be made to have a top cushioning surface 12 and an attachment surface 14 and could be made in any variety of shape including, but not limited to, half-spheroid, pyramidal, cone, triangle or half triangle, square, rectangle, oval, half cylinder, and U-shaped. The dots may be colored by adding coloring agents to the raw material prior to dispersion. A skin 5 may form where the polyurethane or other material contacts the mold as the material fills the cavity of the mold and then solidifies. A texture pattern 16 could be indented into the top cushioning surface 12 either by an injection mold or by machining subsequent to the injection molding process.

Next, a packaging container 52 having an inner surface 54 is provided and the compressible dots 10 are attached thereto using glue, hot melt adhesives, or any other type of adhesive. One or more compressible dots 10 may be affixed in various numbers and spacing patterns to any interior surface 54 of the packaging container 52, including one or more of the bottom surface 56, interior side surfaces 58, the interior top surface 60, and any additional packaging inserts 61. Thus, the compressible dots 10 so arranged in the packaging container 52 comprise a packaging system 50. Finally, a unit or item 62 to be shipped is placed inside the packaging container 52 onto the compressible dots 10 on the bottom surface 56 of the container 52. In exemplary embodiments, the sides and top of the unit 62 will also be cushioned by compressible dots 10 affixed to the side surfaces 58 and top surface 60, respectively, of the packaging container 52. The packaging container 52 can now be closed, sealed and shipped.

With the item 62 to be shipped securely stowed in the packaging system 50, the item 62 will have the required cushioning from the compressible dots 10. More particularly, if the product is relatively light, the compressible dots 10 will only minimally compress and will not increase surface area or density significantly to provide an almost free floating containment cage to protect the product. By contrast, a relatively heavy product will cause the compressible dots to compress to the necessary deflection and achieve a more engineered cushioning system, utilizing increased spring constants, and larger bearing areas required for the product. After the packaging system 50 reaches its destination and the item 62 is removed from the container 52, the compressible dots 10 will return to their original molded shape and the container 52 can be reused.

Cushioning devices and packaging systems as described herein can be used for a wide variety of products and applications in a wide variety of industries. For example, they could be used for consumer electronics, for which the reduced costs, increased protection level, reusability, recyclability, and potential biodegradability would be advantageous. In medical packaging applications, the cleanliness, efficiency, and reusability would be particularly advantageous. For retail packaging, the reduced costs, attractive appearance, low weight, and color-coding would be advantageous. The devices' and systems' scalability, reduced costs, and reusability would be particularly advantageous for industrial uses. In the automotive industry, the reduced costs, reusability, and scalability would be advantageous. For shipping glass, the reduced costs, better protection level, and reusability would be particularly advantageous. For safety equipment, the devices' and systems' higher degree of impact protection, edge and corner protection, and personal impact protection would be advantageous.

Other uses for the disclosed cushioning devices and packaging systems include as void fill because of their ability to fill voids for odd sized products in packages, as standard shipping containers for end customer use, for moving companies as a standard shipping container for moving household and corporate items, as standard PC/Laptop packaging for returning and repaired products, and as airport standard shipping container for stores and airlines. Further disclosure can be found in the contemporaneously filed Appendix A, which is incorporated by reference herein in its entirety.

Thus, it is seen that cushioning devices and packaging systems and methods are provided. It should be understood that any of the foregoing configurations and specialized components or may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

What is claimed is:

1. A packaging system comprising:

a packaging container having an inner surface including an inner top surface;

a packaging insert disposed within the packaging container, the packaging insert having an inner bottom surface and at least one inner side surface;

a plurality of substantially half spheroid-shaped compressible dots, each dot having a top cushioning surface, a skin formed on the top cushioning surface, and a substantially flat attachment surface with a substantially circular bottom edge, the skin providing tackiness and increased friction to grip products in contact with the top cushioning surface;

the compressible dots being attached to the inner top surface of the packaging container and being attached to one or both of the inner bottom surface and the at least one inner side surface of the packaging insert at various locations such that the dots are spaced apart from each other, the dots being movable to accommodate different products having different sizes and shapes;

the compressible dots having an unloaded state density range of about 4-14 pounds per cubic foot and being adapted to adjust inversely proportional to a mechanical load of varying product weights by increasing in density in correlation with increasing compression force exerted on the top cushioning surface of the compressible dots; and the top cushioning surface being adapted to adjust inversely proportional to a mechanical load of varying product weights by increasing in contact surface area in correlation with increasing compression force exerted on the top cushioning surface of the compressible dots;

wherein the increased density and contact surface extends a duration of impact on the top cushioning surface of the compressible dots, thereby extending time of dissipation of energy from the compressible dots.

2. The cushioning device of claim 1 wherein the compressible dot has a half-spheroid shape.

3. The cushioning device of claim 1 wherein the compressible dot has a pyramid shape.

4. The cushioning device of claim 1 wherein the compressible dot has a cone shape.

5. The cushioning device of claim 1 wherein the compressible dot has a half-cylinder shape.

6. The cushioning device of claim 1 wherein the top cushioning surface defines a skin texture pattern indented into the top cushioning surface.

7. A packaging system comprising:

a packaging container having an inner surface including an inner top surface;

at least one packaging insert disposed within the packaging container, the packaging insert having an inner bottom surface and at least one inner side surface; and a plurality of substantially half spheroid-shaped compressible dots, each dot having a top cushioning surface, a skin formed on the top cushioning surface that provides tackiness and increased friction to grip products in contact with the top cushioning surface, and a substantially flat attachment surface with a substantially circular bottom edge, each dot being adapted to adjust inversely proportional to a mechanical load of varying product weights by increasing in density and contact surface area in correlation with increasing compression force exerted on the top cushioning surface of the dots, the increased density and contact surface extending a duration of impact on the dots, thereby extending time of dissipation of energy from the dots;

the compressible dots being attached to the inner top surface of the packaging container and being attached to the inner bottom surface and the inner side surface of the packaging insert at various locations such that the dots are spaced apart from each other, the dots being movable to accommodate different products having different sizes and shapes;

the compressible dots being reusable allowing for multiple uses of the packaging system.

8. The packaging system of claim 7 wherein the compressible dot is adapted to increase in density in correlation with increasing compression force exerted on the compressible dot.

9. The packaging system of claim 7 wherein the top cushioning surface is adapted to increase in contact surface area in correlation with increasing compression force exerted on the compressible dot.

10. The packaging system of claim 7 wherein the compressible dot has one or more of: a half-spheroid shape, a pyramid shape, half-cylinder shape, or a cone shape.

11. The packaging system of claim 7 wherein the top cushioning surface defines a skin texture pattern indented into the cushioning surface.

12. The packaging system of claim 7 wherein the packaging insert further comprises an inner top surface and further comprising a plurality of compressible dots attached to the inner top surface of the packaging insert.

13. A method of packaging products, comprising:

providing a packaging container having an inner surface including an inner top surface;

disposing a packaging insert within the packaging container, the packaging insert having an inner bottom surface and at least one inner side surface;

providing a plurality of substantially half spheroid-shaped compressible dots, each dot having a top cushioning surface and a substantially flat attachment surface with a substantially circular bottom edge;

forming a skin on the top cushioning surface such that the skin provides tackiness and increased friction to grip products in contact with the top cushioning surface;

attaching the compressible dots to the inner top surface of the packaging container and to one or both of the inner bottom surface and the at least one inner side surface of the packaging insert at various locations such that the dots are spaced apart from each other, the dots being movable to accommodate different products having different sizes and shapes;

re-using the compressible dots for multiple uses of the packaging system;

the compressible dots being adapted to adjust inversely proportional to a mechanical load of varying product weights by increasing in density in correlation with increasing compression force exerted on the top cushioning surface of the compressible dots; and the top cushioning surface being adapted to adjust inversely proportional to a mechanical load of varying product weights by increasing in contact surface area in correlation with increasing compression force exerted on the top cushioning surface of the compressible dots;

wherein the increased density and contact surface extends a duration of impact on the top cushioning surface of the dots, thereby extending time of dissipation of energy from the dots.

14. The method of claim 13 further comprising indenting a skin texture pattern into the top cushioning surface of the compressible dot.

15. The method of claim 13 further comprising placing an item to be shipped in the packaging container.

16. The method of claim 13 wherein the packaging insert further comprises an inner top surface and further comprising attaching a plurality of compressible dots to the inner top surface of the packaging insert.

* * * * *